US010116077B1

(12) United States Patent
Gleisner

(10) Patent No.: US 10,116,077 B1
(45) Date of Patent: Oct. 30, 2018

(54) KIT HAVING A TUBE SURROUNDING AN END PORTION OF A TRACER WIRE AND A CONDUCTIVE END CAP ENGAGING THE TUBE AND THE WIRE

(71) Applicant: Engineered Energy Products, LLC, Monticello, MN (US)

(72) Inventor: Scott Richard Gleisner, Buffalo, MN (US)

(73) Assignee: Engineered Energy Products, LLC, Monticello, MN (US)

( * ) Notice: Subject to any disclaimer, the term of this patent is extended or adjusted under 35 U.S.C. 154(b) by 0 days.

(21) Appl. No.: 15/718,873

(22) Filed: Sep. 28, 2017

Related U.S. Application Data

(60) Provisional application No. 62/400,897, filed on Sep. 28, 2016.

(51) Int. Cl.

| | |
|---|---|
| ***H01R 13/52*** | (2006.01) |
| ***H01R 13/02*** | (2006.01) |
| ***H01R 4/34*** | (2006.01) |
| ***H01R 13/40*** | (2006.01) |
| ***H01R 11/28*** | (2006.01) |

(52) U.S. Cl.
CPC ..... *H01R 13/02* (2013.01); *H01R 4/34* (2013.01); *H01R 11/284* (2013.01); *H01R 13/40* (2013.01)

(58) Field of Classification Search
CPC .... H01R 4/22; H01R 11/284; H01R 13/5213; H01R 13/533; H01R 13/60; H01R 33/965
USPC ..... 439/278, 283, 367, 519, 521, 527
See application file for complete search history.

(56) References Cited

U.S. PATENT DOCUMENTS

| | | | | |
|---|---|---|---|---|
| 5,603,020 | A * | 2/1997 | Hashimoto | G06F 17/30067 |
| 9,698,518 | B1 * | 7/2017 | King, Jr. | H01R 13/5216 |
| 2005/0191882 | A1 * | 9/2005 | Torii | H01R 4/22 439/98 |
| 2006/0048965 | A1 * | 3/2006 | Ootsuki | H01R 4/22 174/74 A |
| 2008/0236863 | A1 * | 10/2008 | King | H01R 4/22 174/92 |
| 2008/0254664 | A1 * | 10/2008 | Hiner | H01R 4/70 439/283 |

OTHER PUBLICATIONS

English Translation of CN203963375 published Nov. 26, 2014.*

* cited by examiner

*Primary Examiner* — Chandrika Prasad
(74) *Attorney, Agent, or Firm* — Peter J. Ims; Westman, Champlin & Koehler, P.A.

(57) ABSTRACT

A kit for use with an above ground portion of a tracer wire includes a tube and a conductive end cap. The tube has an interior cavity extending from a first end to a second end, and the internal cavity has a diameter configured to be positioned about the tracer wire. The conductive end cap is configured to electrically engage the tracer wire, and is further configured to mechanically engage a surface of the tube such that the tracer wire is protected from corrosion and external elements while allowing a signal to be sent along the tracer wire through the conductive end cap.

19 Claims, 2 Drawing Sheets

KIT HAVING A TUBE SURROUNDING AN END PORTION OF A TRACER WIRE AND A CONDUCTIVE END CAP ENGAGING THE TUBE AND THE WIRE

CROSS-REFERENCE TO RELATED APPLICATION(S)

The present application claims priority to U.S. Provisional Patent Application Ser. No. 62/400,897, entitled "Conductive End Cap and Tube for Tracer Wire," filed Sep. 28, 2016, which is hereby incorporated by reference in its entirety.

BACKGROUND

The present disclosure relates to a device for use with an above ground portion of a tracer wire, where the tracer wire is typically installed with a utility pipeline. More particularly, the present disclosure relates to a tube configured to be positioned about the above ground portion of the tracer wire and a conductive end cap configured to be conductively secured to the end of the tracer wire and secured within the opening in the tube where the conductive end can be sold by itself or as a kit with a tube.

Tracer wires are commonly located proximate a buried utility pipeline to allow a signal to be transmitted along the tracer wire where the signal is detectable by a receiver. The detected signal can be followed along the length of the tracer wire and therefore identify the location of the buried pipeline. By locating the buried pipeline, inadvertent or accidental rupture or destruction of the pipeline can be prevented, which can occur during construction, excavation of a site or installation of other pipes or cables. In particular, a release of hydrocarbon, such as natural gas, can be extremely dangerous and can lead to explosive conditions that should be avoided.

It is common to locate the above ground portion of the tracer wire proximate a meter set. As the meter set is above ground, the tracer wire can be located proximate the piping above ground to provide access to the tracer wire while the meter set piping provides some protection.

However, there are several drawbacks to leaving a tracer wire in plain view to the public and or people who are working around the above ground portion of the tracer wire. Some drawbacks include that the wire is not aesthetically pleasing to view. Further, in some instances the tracer wire may be cut at ground level by people who do not understand the importance or usefulness of the tracer wire.

In some instances, the tracer wire may be near or in an area that requires trimming. For instance, a string trimmer or other lawn cutting equipment can cause damage to or even cut the tracer wire.

Also, when exposed to the elements, polymeric coatings around the tracer wire can degrade due to exposure to ultraviolet light. This degradation of the coating can lead to cracks in the coating that can result in oxidation of the metal tracer wire. Further, exposure to the elements can result in oxidation or corrosion of the wire, which can create a non-conductive outer layer, resulting in impendence or prevention of the signal being sent down the tracer wire.

Therefore, there is a need of a device and kit that protects the tracer wire from ground level to the end of the wire which prevents exposure to the elements and protects the wire from damage while being aesthetically pleasing.

SUMMARY

In one aspect of the present disclosure, a kit for use with an above ground portion of a tracer wire includes a tube and a conductive end cap. The tube has an interior cavity extending from a first end to a second end, and the internal cavity has a diameter configured to be positioned about the tracer wire. The conductive end cap is configured to electrically engage the tracer wire, and is further configured to mechanically engage a surface of the tube such that the tracer wire is protected from corrosion and external elements while allowing a signal to be sent along the tracer wire through the conductive end cap.

In another aspect, a conductive end cap for use with an above ground portion of a tracer wire includes a first portion that is substantially cylindrical, a second portion located adjacent to the first portion, a third portion located adjacent to the second portion and opposite the first portion, and a securing mechanism configured to create and electrical connection between the tracer wire and the conductive end cap. A perimeter of the second portion is larger than a perimeter of the first portion, and the third portion has a smaller perimeter than both the first and second portions. An internal cavity extends through an entire length of the first portion and into the second portion.

In yet another aspect, a method for use with a tracer wire located proximate to a buried utility pipeline includes positioning a tube about an above-ground portion of the tracer wire, with the tracer wire extending along an interior cavity of the tube such that the tube extends along substantially an entire length of the above-ground portion of the tracer wire, engaging a conductive end cap with an end of the tube, such that a weather-proof seal is formed between the conductive end cap and the tube, and creating an electrical connection between the tracer wire and the conductive end cap with a securing mechanism.

The present summary is provided only by way of example, and not limitation. Other aspects of the present invention will be appreciated in view of the entirety of the present disclosure, including the entire text, claims and accompanying figures.

Figure 1:
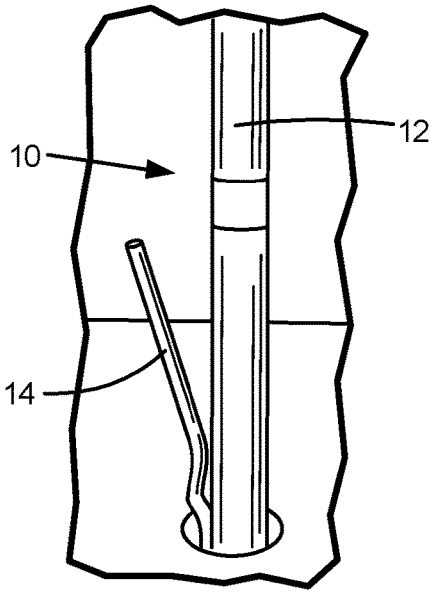
FIG. 1 (PRIOR ART)
FIG. 1 is a front perspective view of a typical prior art installation of a tracer wire proximate to a meter set.

While the above-identified figures set forth one or more embodiments of the present invention, other embodiments are also contemplated, as noted in the discussion. In all cases, this disclosure presents the invention by way of representation and not limitation. It should be understood that numerous other modifications and embodiments can be devised by those skilled in the art, which fall within the scope and spirit of the principles of the invention. The figures may not be drawn to scale, and applications and embodiments of the present invention may include features, steps and/or components not specifically shown in the drawings.

DETAILED DESCRIPTION

The present disclosure relates to an apparatus and associated kit for protecting an above ground portion of a tracer wire that is typically located proximate a meter set. The present disclosure provides an aesthetically pleasing visual impact that protects the above ground portion of the tracer wire from damage and also provides a non-corroding conductive contact with an end of the wire while preventing corrosion of the tracer wire.

Pipelines, such as a branch service line that transfers utilities to a premise from a main line, or a distribution line that transfers utilities to multiple premises, may extend underground or through otherwise inaccessible areas. One example utility is natural gas that is transferred through a network to individual premises. However, if a pipe is cut or otherwise punctured, the release of natural gas could be ignited and become very dangerous. Therefore, a mechanism to locate the inaccessible pipeline is needed. But such pipelines may be made of materials that are not easily remotely detected. For instance, a buried pipeline may be made of a non-electrically conductive material that is not capable of conducing a tracer signal to enable detection from above ground. Therefore, to prevent the cutting or puncturing of a utility pipeline, a tracer wire is buried along with the pipe where an end portion is of the tracer wire located above ground for access. A below ground portion of the tracer wire is located proximate the buried pipe, and can extend along all or part of the buried pipe.

To detect the location of the buried or inaccessible pipeline, a device is typically connected to the above ground portion of the tracer wire to transmit a signal down the tracer wire (e.g., underground) where the signal is remotely detectable with another device. Detection of the signal allows personnel working in the area to locate the buried pipe.

FIG. 1 illustrates a typical prior art installation 10 that includes a meter set 12 and a tracer wire 14. The tracer wire 14 is illustrated as being a distance from the meter set 12. In some instances, the tracer wire 14 is wrapped around the meter set 12. Whatever the configuration of the tracer wire 14 relative to the meter set 12, the tracer wire 14 is susceptible to damage, such as, but not limited to being damaged by lawn equipment, being intentionally cut or vandalized, coating breakdown due to exposure to ultraviolet light and/or corrosion. Even if a portion of the tracer wire 14 remains intact below ground, such a portion of the tracer wire is just as inaccessible as the buried pipe. Damage or partial removal of the tracer wire 14 under such circumstances prevents transmission of the signal down the tracer wire 14, which in turn prevents personnel from identifying the location of the buried pipe.

Figure 2:
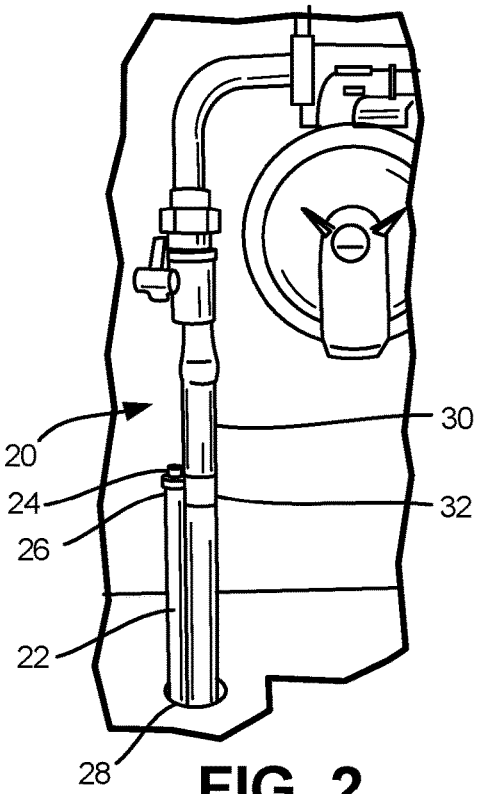
FIG. 2 is a front perspective view of an installation of a tube and a wire cap of the present disclosure installed proximate a meter set.

FIG. 2 illustrates a new installation 20 where a tube 22 is positioned about the tracer wire and a conductive end cap 24 is connected to the tracer wire. The conductive end cap 24 is configured to be inserted into an interior cavity of the tube 22 to create a substantially weather-proof seal and to retain the conductive end cap 24 within a top end 26 of the tube 22. The tube 22 has a bottom end 28 that is located proximate ground level, such that the above ground portion of the tracer wire 14 (not visible in FIG. 2) is protected by the tube 22 and the conductive end cap 24. Once the tube 22 is positioned about the above ground portion of the tracer wire 14, the conductive end cap 24 is secured to the end of the tracer wire 14. In the illustrated embodiment, the conductive end cap 24 is secured within the interior cavity of the tube 22 at the top end 26, though in alternative embodiments the conductive end cap could be secured about an exterior of the tube 22 and the top end 26. The tube 22 can optionally be secured to a pipe 30 of the meter set 12 with an adhesive tape 32. However, other securing mechanisms are within the scope of the present disclosure, including but not limited to a zip tie, twist tie, a clamp, a bracket, and the like.

The installation 20 can be a new installation of the meter set 12 and the tracer wire 14, or can involve a retro-fit of the tube 22 and the conductive end cap 24 to an existing meter set 12 and tracer wire 14.

When sold as a kit, the tube 22 has a length that is typically longer than required to be positioned about the above ground portion of the tracer wire 14. The installer can cut the tube 22 to a desired length and then secure the conductive end cap 24 to the tracer wire 14 and within the tube 22. The tube 22 is then optionally secured to the pipe 30 of the meter set 12. Alternatively, the tube 22 can be provided at a selected length, such as but not limited to about 18 inches, and the wire can be cut to length or manipulated to be positioned within the tube 22.

A typical material of construction for the tube 22 is polyethylene. However, the material of the tube 22 is not limited to polyethylene and can be any suitable material of construction, such as any suitable non-electrically-conductive polymer material. A typical size of the tube 22 is a half inch copper tube size (CTS). However, other sizes of the tube 22 are within the scope of the present disclosure.

Figure 3:
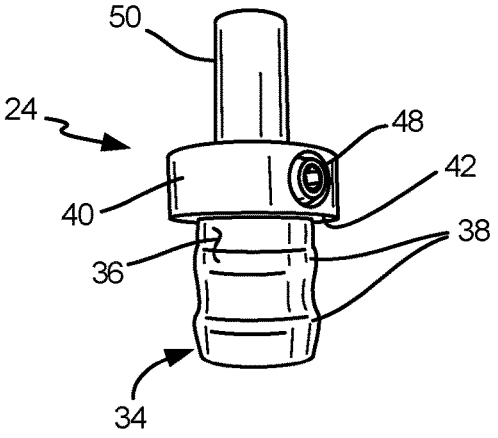
FIG. 3 is a front elevation view of the wire cap of the present disclosure.
Figure 4:
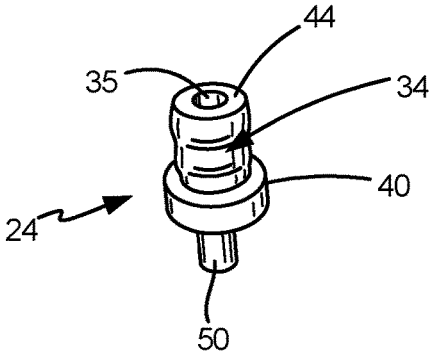
FIG. 4 is a bottom perspective view of the wire cap of the present disclosure.
Figure 5:
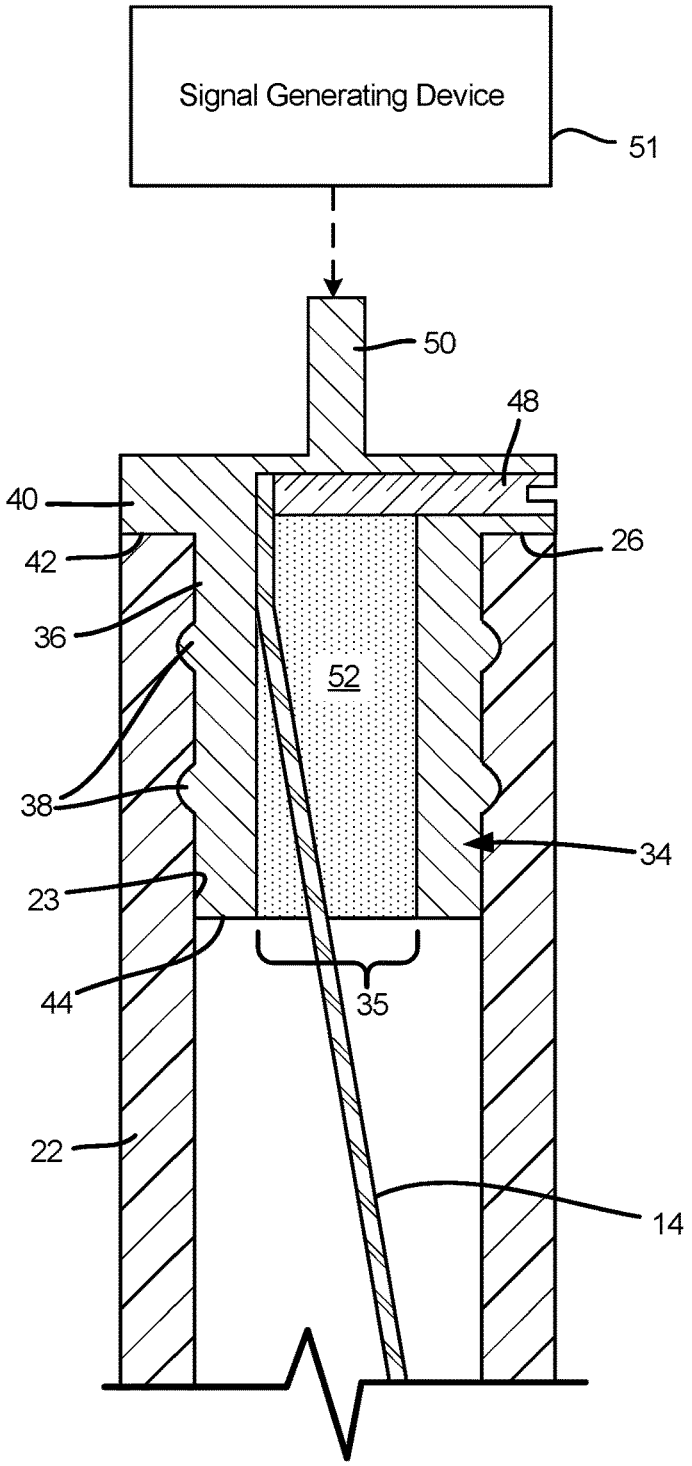
FIG. 5 is a cross-sectional view of the tube and the wire cap of the present disclosure.

Referring to FIGS. 3-5, the illustrated embodiment of the conductive end cap 24 includes a bottom (or first) portion 34 that has a substantially cylindrical exterior surface 36 with a plurality of ridges or barbs 38. The exterior surface 36 is configured to engage an interior surface 23 of the tube 22 where the ridges or barbs 38 frictionally engage the interior surface 22 and resist the removal of the conductive end cap 24 from the tube 22. Additional or alternative securing mechanisms, such as threaded fasteners, band clamps, adhesives, and the like can be used in further embodiments.

The conductive end cap 24 of the illustrated embodiment further includes a middle (or second) portion 40 that has a diameter (or perimeter) that is greater than a diameter (or perimeter) of the interior surface 23 of the tube 22 such that a bottom surface 42 of the middle portion 40 engages the top end 26 of the tube 22 and prevents end cap 24 from being further inserted into the tube 22. While the middle portion 40 is substantially cylindrical in the illustrated embodiment, in further embodiments the middle portion 40 could have other shapes, such as having a rectangular perimeter, etc.

The bottom portion 34 includes an internal cavity 35 that extends from a distal end 44 of the conductive end cap 24 through an entire length of the bottom portion 34 and into the middle portion 40, to at least even with a top surface 43 of the middle portion 40. In the illustrated embodiment, the middle portion 40 includes a threaded bore 46 that is in communication with the internal cavity 35 such that when the conductive end cap 24 is positioned about the end of the tracer wire, a set screw 48 can be manipulated to frictionally secure the tracer wire 14 to the conductive end cap 24 where conductive contact is made with an interior surface of the internal cavity 35 and the tracer wire 14. In alternate embodiments, the internal cavity could be threaded to threadably engage the tracer wire 14, or could have push fit mechanisms (e.g., "shark bite" engagements) to engage the tracer wire 14, for example.

A top (or third) portion 50 of the conductive end cap 24 is substantially cylindrical in configuration, and can be smaller in diameter (or perimeter) than both the bottom portion 34 and the middle portion 40. The top portion 50 has a diameter that is compatible with a connector of a signal generating device 51 such that a signal can be sent down the tracer wire 14 to locate the associated underground pipe (e.g., a buried portion of the pipe 30).

The conductive end cap 24 is typically constructed with aluminum which is conductive and corrosion resistant. However, other conductive materials can be utilized to form the end cap 24.

Further, the conductive end cap 24 is typically machined from a single piece of material, such that the end cap 24 is of a monolithic construction. However, the end cap 24 can have a composite construction where the top portion 50 and the middle portion 40 are of conductive material and the bottom portion is a non-conductive material.

The internal cavity 35 is typically filled with a corrosion resistant, corrosion displacing gel 52 to physically contact the tracer wire 14 and to prevent corrosion of the tracer wire 14 within the internal cavity 35. However, the gel 52 is optional and not necessary to practice the present disclosure.

Although the present invention has been described with reference to preferred embodiments, workers skilled in the art will recognize that changes may be made in form and detail without departing from the spirit and scope of the invention.

The invention claimed is:

1. A kit for use with an above ground portion of a tracer wire, the kit comprising:

a tube having an interior cavity extending from a first end to a second end, wherein the internal cavity has a diameter configured to be positioned about the tracer wire; and a conductive end cap configured to electrically engage the tracer wire and further configured to mechanically engage a surface of the tube such that the tracer wire is protected from corrosion and external elements while allowing a signal to be sent along the tracer wire through the conductive end cap, wherein the conductive end cap comprises; a first portion having an internal cavity and an exterior surface; and a securing mechanism, wherein when the kit is installed the securing mechanism provides an electrical connection between the tracer wire and the conductive end cap.

2. The kit of claim 1, wherein the surface of the tube that mechanically engages with the conductive end cap defines the interior cavity of the tube.

3. The kit of claim 1, wherein the tube is made of a non-electrically-conductive polymer material.

4. The kit of claim 1, wherein the tube is made of polyethylene.

5. The kit of claim 1, wherein the tube has a length from the first end to the second end of approximately 18 inches.

6. The kit of claim 1, wherein the conductive end cap is made of aluminum.

7. The kit of claim 1, wherein the conductive end cap further comprises:

a second portion located adjacent to the first portion, wherein the second portion has a greater diameter than the first portion.

8. The kit of claim 7, wherein a barb is located on the exterior surface of the first portion.

9. The kit of claim 7, wherein the conductive end cap further comprises:

a third portion located adjacent to the second portion, opposite the first portion, wherein the third portion provides an electrical connector having a smaller diameter than both the first and second portions.

10. The kit of claim 1, wherein the securing mechanism comprises a set screw engaged with the second portion, wherein the internal cavity extends into the second portion, and wherein the set screw is threadably adjustable to force the tracer wire into conductive contact with a surface defining the internal cavity.

11. The kit of claim 1 and further comprising:

a corrosion displacing gel located in the interior cavity of the conductive end cap and in physical contact with the tracer wire.

12. A conductive end cap for use with an above ground portion of a tracer wire, the conductive end cap comprising:

a first portion, wherein the first portion is substantially cylindrical;

a second portion located adjacent to the first portion, wherein a perimeter of the second portion is larger than a perimeter of the first portion, and wherein an internal cavity extends through an entire length of the first portion and into the second portion;

a third portion located adjacent to the second portion and opposite the first portion, wherein the third portion has a smaller perimeter than both the first and second portions; and a securing mechanism providing an electrical connection between the tracer wire and the conductive end cap.

13. The conductive end cap of claim 12, wherein the conductive end cap is made of aluminum.

14. The conductive end cap of claim 12, wherein a barb is located on an exterior surface of the first portion.

15. The conductive end cap of claim 12, wherein the third portion defines a substantially cylindrical electrical connector.

16. The conductive end cap of claim 12, wherein the securing mechanism comprises a set screw engaged with the second portion, and wherein the set screw is threadably adjustable to force the tracer wire into conductive contact with a surface defining the internal cavity.

17. The conductive end cap of claim 12 and further comprising:

a corrosion resistant and corrosion displacing gel located in the interior cavity of the conductive end cap.

18. A method for use with a tracer wire located proximate to a buried utility pipeline, the method comprising:

positioning a tube about an above-ground portion of the tracer wire, with the tracer wire extending along an interior cavity of the tube such that the tube extends along substantially an entire length of the above-ground portion of the tracer wire;

engaging a conductive end cap with an end of the tube, such that a weather-proof seal is formed between the conductive end cap and the tube; and creating an electrical connection between the tracer wire and the conductive end cap with a securing mechanism.

19. The method of claim 18 and further comprising:

engaging a signal generating device with the conductive end cap; and transmitting a signal along the tracer wire, such that the signal can be remotely detected to identify the location of the buried utility pipeline, wherein the signal is transmitted through the interior cavity of the tube.

* * * * *